US008475203B2

(12) United States Patent
Wu

(10) Patent No.: US 8,475,203 B2
(45) Date of Patent: Jul. 2, 2013

(54) CABLE ASSEMBLY HAVING INDICATING DEVICE

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 276 days.

(21) Appl. No.: 13/089,333

(22) Filed: Apr. 19, 2011

(65) Prior Publication Data

US 2011/0256769 A1 Oct. 20, 2011

(51) Int. Cl.
*H01R 3/00* (2006.01)

(52) U.S. Cl.
USPC ..... 439/490

(58) Field of Classification Search
USPC ..... 439/490, 76.1, 620.22
See application file for complete search history.

(56) References Cited

U.S. PATENT DOCUMENTS

| | | | | |
|---|---|---|---|---|
| 4,386,818 | A * | 6/1983 | Millhimes et al. | 439/490 |
| 6,165,006 | A * | 12/2000 | Yeh et al. | 439/490 |
| 6,572,402 | B2 * | 6/2003 | Lin | 439/490 |
| 6,743,044 | B2 * | 6/2004 | Musolf et al. | 439/490 |
| 6,888,423 | B2 * | 5/2005 | Tresness et al. | 333/185 |
| 6,957,982 | B1 * | 10/2005 | Hyland et al. | 439/620.05 |
| 7,094,104 | B1 * | 8/2006 | Burke et al. | 439/620.01 |
| 7,393,237 | B2 * | 7/2008 | Kuo | 439/490 |
| 7,429,188 | B2 * | 9/2008 | Wu | 439/490 |
| 7,607,937 | B1 * | 10/2009 | Chang | 439/490 |
| 7,677,916 | B2 * | 3/2010 | Chang | 439/490 |
| 7,683,739 | B2 * | 3/2010 | Wang | 333/172 |
| 7,722,362 | B2 * | 5/2010 | Frake et al. | 439/76.1 |
| 7,722,363 | B2 * | 5/2010 | Zhou et al. | 439/76.1 |
| 7,736,156 | B2 * | 6/2010 | Ko | 439/76.1 |
| 7,789,675 | B2 * | 9/2010 | Zhang et al. | 439/76.1 |
| 7,914,320 | B2 * | 3/2011 | Ko | 439/490 |
| 7,976,336 | B2 * | 7/2011 | Yang et al. | 439/490 |
| 8,124,496 | B2 * | 2/2012 | Su et al. | 438/449 |
| 8,333,608 | B2 * | 12/2012 | Ko | 439/490 |
| 2010/0309657 | A1 * | 12/2010 | Purdy et al. | 362/200 |
| 2011/0256769 | A1 * | 10/2011 | Wu | 439/620.02 |

* cited by examiner

*Primary Examiner* — Neil Abrams
(74) *Attorney, Agent, or Firm* — Wei Te Chung; Ming Chieh Chang

(57) ABSTRACT

A cable assembly (100) includes an insulative housing (1) having a top side, and a cavity (111) is defined in the top side; a plurality of contacts (2) received in insulative housing, said the contacts including two power contacts partially disposed under the cavity; a plurality of wires (3) electrically connected to the contacts, respectively; a printed circuit board assembly (5) received in the cavity, the printed circuit board assembly (5) having a substrate (50) with a light emitting diode (504) thereon, the lighting emitting diode electrically connected with the two power contact; and a light guide member (6) assembled to the cavity and located above the light emitting diode.

20 Claims, 5 Drawing Sheets

CABLE ASSEMBLY HAVING INDICATING DEVICE

BACKGROUND OF THE INVENTION

1. Field of the Invention

The present invention relates to a cable assembly, more particularly to a cable assembly equipped with indicating device.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

However, as a USB connector have an outer metallic shell, and it is difficult to observe working status when the USB connector is connected to an electronic device. Hence, an improved connector is desired to overcome aforementioned problem.

BRIEF SUMMARY OF THE INVENTION

Accordingly, an object of the present invention is to a cable assembly with a indicating device.

In order to achieve the above-mentioned object, a cable assembly in accordance with present invention comprises an insulative housing having a top side, and a cavity is defined in the top side; a plurality of contacts received in insulative housing, said the contacts including two power contacts partially disposed under the cavity; a plurality of wires electrically connected to the contacts, respectively; a printed circuit board assembly received in the cavity, the printed circuit board assembly having a substrate with a light emitting diode thereon, the lighting emitting diode electrically connected with the two power contact; and a light guide member assembled to the cavity and located above the light emitting diode.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
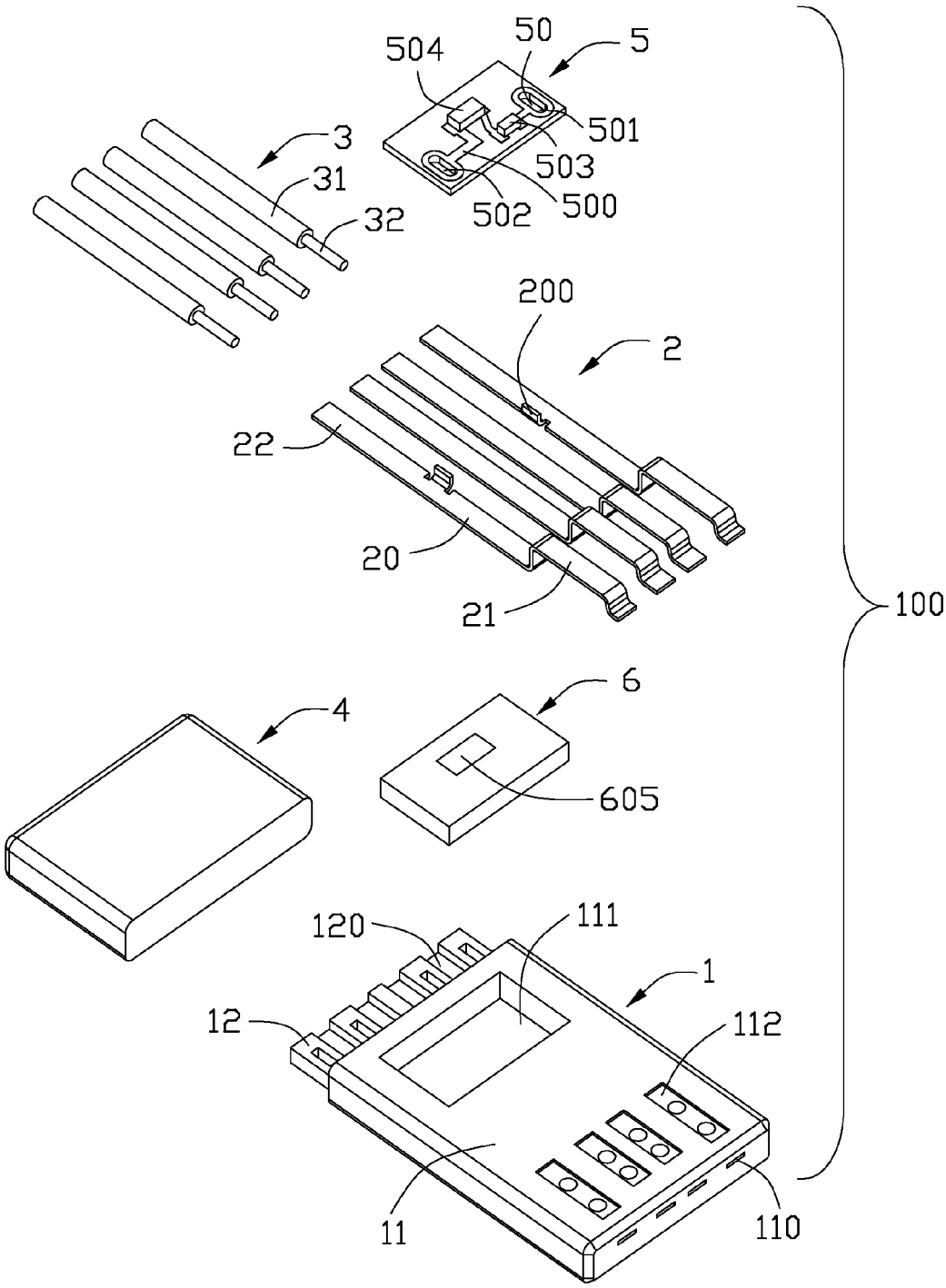
FIG. 1 is an exploded, perspective view of a cable assembly in accordance with the present invention.

In the following description, numerous specific details are set forth to provide a thorough understanding of the present invention. However, it will be obvious to those skilled in the art that the present invention may be practiced without such specific details.

Reference will be made to the drawing figures to describe the present invention in detail, wherein depicted elements are not necessarily shown to scale and wherein like or similar elements are designated by same or similar reference numeral through the several views and same or similar terminology.

Figure 2:
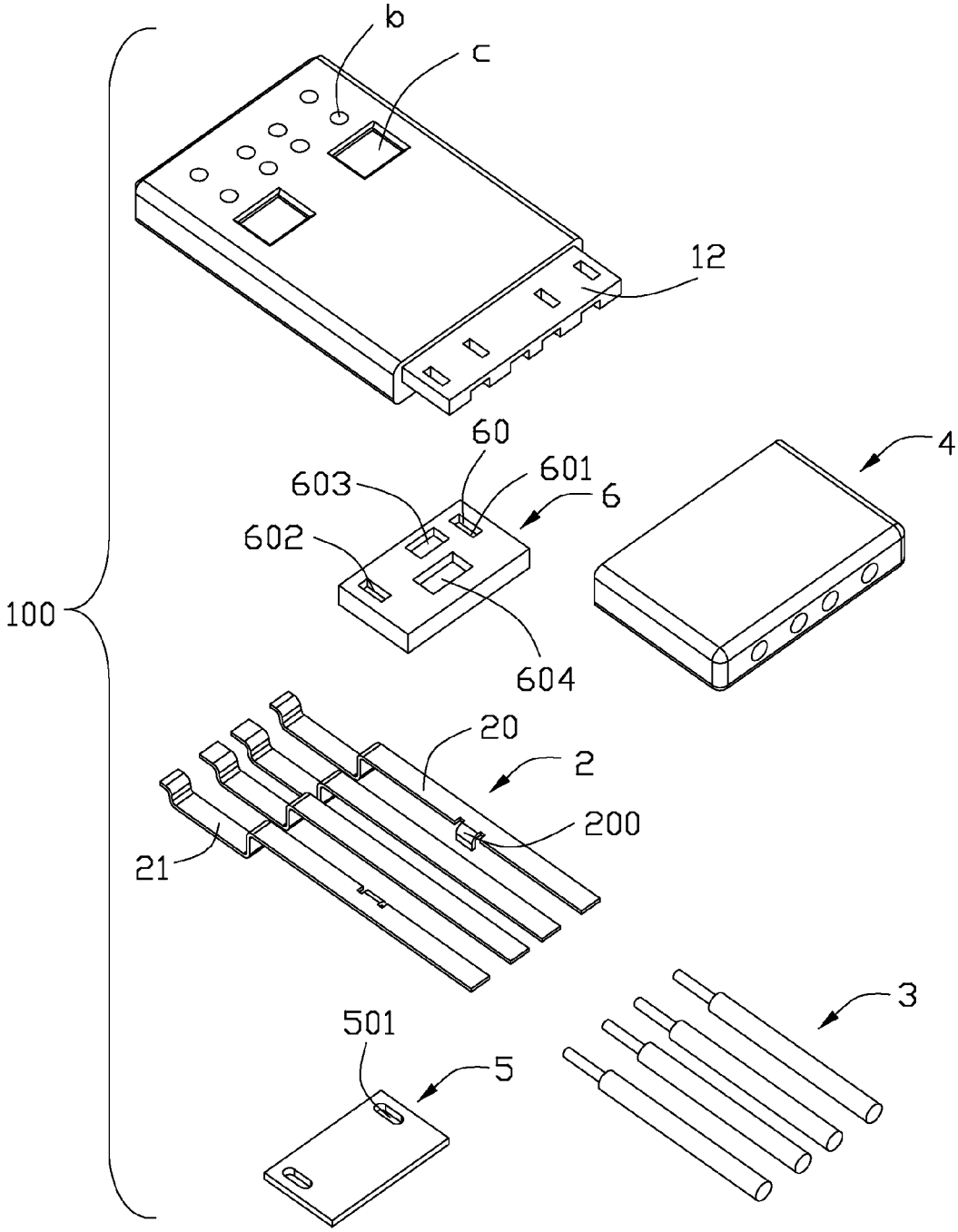
FIG. 2 is similar to FIG. 1, but viewed from another aspect.
Figure 3:
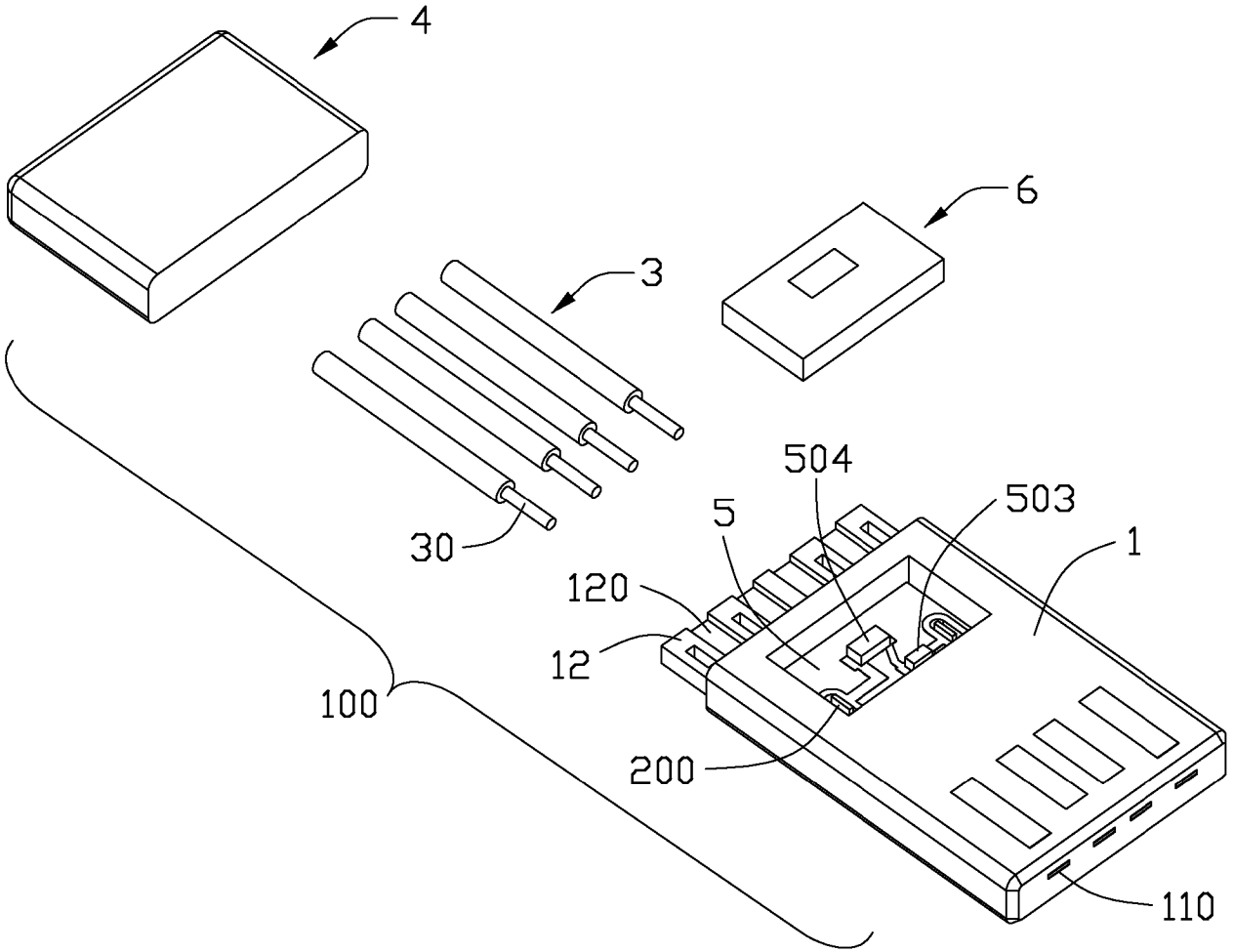
FIG. 3 is partially assembled, perspective view of the cable assembly.
Figure 4:
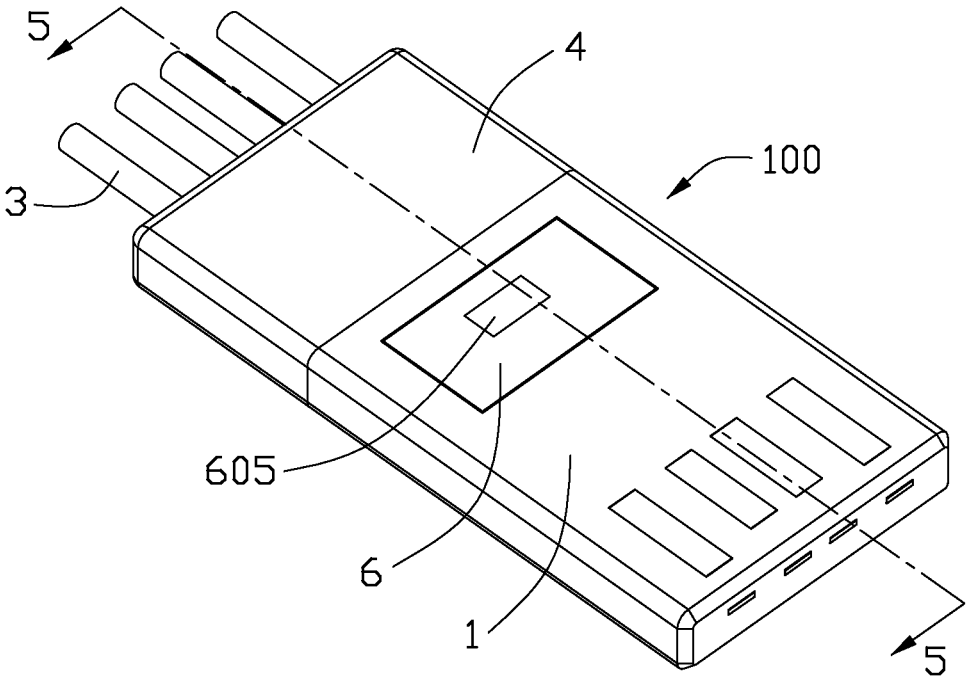
FIG. 4 is an assembled, perspective view of the cable assembly.
Figure 5:
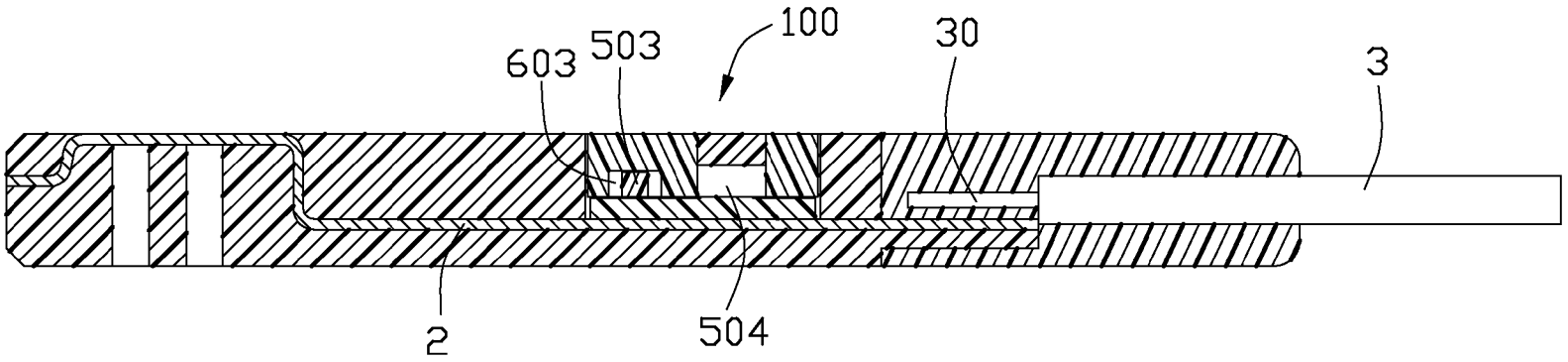
FIG. 5 is a cross-section view of FIG. 1 taken along line 5-5.

Referring to FIGS. 1-5, a cable assembly 100 according to the present invention comprises an insulative housing 1, a plurality of contacts 2 supported by the insulative housing 1, a plurality of wires 3 connected to the contacts 2, and an insulator 4 formed around connection area between the contacts 2 and the wires 3. The cable assembly 100 further comprises a printed circuit board assembly (PCBA) 5 and a light guiding member 6.

The insulative housing 1 is a board shaped member and includes a main portion 11 and a platform 12 extending backwardly from the main portion 11. There are a number of contact grooves 110 through the main portion 11 along a front-to-back direction. In addition, a cavity 111 is defined in a back segment of a top side of the main portion 11 and communicates with the contact grooves 110. Also, there are a number of longitudinal depressions 112 located in a front segment of the top side of the main portion 11 and communicate with the contact grooves 110, respectively. A number of slots 120 defined in a top side of the platform 12 and respectively align with the contact grooves 110 along the front-to-back direction.

There are four contacts 2 in the present embodiment, and each contact 2 includes a planar retention portion 20 received in the corresponding contact groove 110, a tail portion 22 extending backwardly from the retention portion 20 and accommodated in the corresponding slot 120 of the platform 12, and a mating portion 21 raised upwardly from the retention portion 20 and located in the corresponding depression 112. In addition, partial of the retention portion 20 is exposed in the cavity 111. The four contact contacts 2 includes two power contacts located at lateral sides and two signal contacts disposed between the two power contacts. A tab 200 projects upwardly from the retention portion 20 of each power contact and extends into the cavity 111.

Each of the wires 3 has an inner conductor 32 and an outer jacket 31 enclosing the inner conductor 32.

The PCBA 5 has substrate 50, and there are two conductive holes 501, 502 respectively defined in lateral sides of the substrate 50. A resistance 503 is mounted to the substrate 50 and disposed between the two conductive holes 501, 502. Also, a Light emitting diode (LED) 504 is mounted to the substrate and disposed behind the resistance 503. The conduct holes 501, 502, the resistance 503 and the LED 504 are electrically connected with each other by a conductive line 500 attached to the substrate 50.

The a light guiding member 6 has a main portion 60, with a pair of first slots 601, 602 aligning with the conductive holes 501, 502 for accommodating the tabs 200, a second slot 603 for accommodating the resistance 503 and a third slot 604 for accommodating the LED 504. There is a light guide film 605 located in the third slot 604 and substantially coplanar to a top side of the light guiding member 6.

When assembling, the contacts 2 are insert-molding with the insulative housing 1, with the retention portions 20 disposed under the cavity 111, then the outer jacket 31 of each wire 3 is partially removed away to expose the inner conductor 32 outside, and the inner conductor 32 is place on the tail portion 22 and soldered thereto, and then the insulator 4 is molded over the platform 12 and encloses connection area between the inner conductors 32 and the tail portions 22. The PCBA 5 is put into the cavity 111 and supported by the retention portions 20 of the contacts 2, with the tabs 200 inserted into and engaging with the two conductive holes 501, 502, and distal ends of the tabs 200 upwardly extending beyond a top side of the substrate 50. The light guiding member 6 is pressed into the cavity 111, with the distal ends of the tabs 200 extending into first slots 601, 602, and the light guide film 605 located above and disposed adjacent to the light emitting diode 504. As the light guide member 6 is located in the cavity 111 and it is easily for a user to observe on/off status of the LED 504 via the light guide film 605.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. A cable assembly, comprising:

an insulative housing having a top side and a cavity on the top side;

a plurality of contacts received in insulative housing, the contacts including two power contacts partially disposed under the cavity;

a plurality of wires electrically connected to the contacts, respectively;

a printed circuit board assembly received in the cavity, the printed circuit board assembly having a substrate and a light emitting diode on the substrate, the lighting emitting diode electrically connected with the two power contact; and a light guide member assembled to the cavity and located above the light emitting diode.

2. The cable assembly as claimed in claim 1, wherein the substrate has two conductive holes respectively defined in lateral sides thereof, and there are two tabs respectively formed on the two power contacts and extending into the two conductive holes.

3. The cable assembly as claimed in claim 2, wherein the lighting diode is arranged between the two conductive holes.

4. The cable assembly as claimed in claim 3, wherein the two conductive holes and the light emitting diode is electrically connected with each other by a conductive line attached on the substrate.

5. The cable assembly as claimed in claim 4, wherein there is a resistance connected with the light emitting diode and one of the two conductive holes.

6. The cable assembly as claimed in claim 2, wherein the light guide member has a main portion with a pair of first slots aligning with the conductive holes, and the two tabs pass through the conductive holes and extend into the first slots, respectively.

7. The cable assembly as claimed in claim 5, wherein the light guide member has a main portion with a second slot accommodating the resistance.

8. The cable assembly as claimed in claim 7, wherein the light guide member has a main portion with a third slot accommodating the light emitting diode.

9. The cable assembly as claimed in claim 8, wherein there is a light guide film located in the third slot.

10. The cable assembly as claimed in claim 9, wherein the light guide film is substantially coplanar to a top side of the light guiding member.

11. The cable assembly as claimed in claim 9, wherein the light guide film is disposed adjacent to the light emitting diode.

12. The cable assembly as claimed in claim 1, wherein the contacts further have two signal contacts located between the two power contacts.

13. The cable assembly as claimed in claim 1, wherein the contacts have planar retention portions received in the insulative housing and mating portions raised upwardly from the retention portion and respectively located in corresponding depressions which are defined in the top side of the insulative housing.

14. The cable assembly as claimed in claim 13, wherein the insulative housing further has a platform at a back side thereof, and the contacts have tail portions extending backwardly from the retention portions and accommodated in corresponding slots defined in the platform.

15. The cable assembly as claimed in claim 14, wherein there is an insulator molded over the platform and encloses connection area between the inner conductors and the tail portions.

16. The cable assembly as claimed in claim 13, wherein the printed circuit board assembly is supported by the retention portions of the contacts.

17. An electrical connector comprising:

an insulative housing defining opposite upper and bottom surfaces thereof;

a plurality of contacts disposed in the housing, each of said contacts defining a front contacting section exposed upon the upper surface, a rear tail section connecting to a corresponding wire and a medium section therebetween;

a printed circuit board associated with the housing and mechanically and electrically connected to the corresponding medium sections of at least two of said contacts;

an LED (Light Emitting Diode) mounted to the printed circuit board to expose light upon the upper surface.

18. The electrical connector as claimed in claim 17, wherein the contacts are insert molded in the housing while the printed circuit board and the associated LED are assembled into a corresponding cavity in the housing.

19. The electrical connector as claimed in claim 17, wherein a light guide member is positioned upon the printed circuit board with a slot to receive the LED therein and protect the LED from being directly exposed to an exterior in the upper surface.

20. An electrical connector comprising:

an insulative housing;

a plurality of contacts disposed in the housing; each of said contacts defining a front contacting section exposed upon the upper surface, a rear tail section connecting to a corresponding wire and a medium section therebetween;

a printed circuit board associated with the housing and mechanically and electrically connected to at least two of said contacts;

an LED (Light Emitting Diode) mounted to the printed circuit board to expose light upon the upper surface; and a light guide member positioned upon the printed circuit board and defining a slot to circumferentially enclose the LED therein and protect the LED from being directly exposed upon the upper surface.

* * * * *